United States Patent [19]

Maekawa et al.

[11] Patent Number: 4,474,873

[45] Date of Patent: Oct. 2, 1984

[54] SILVER HALIDE PHOTOGRAPHIC LIGHT-SENSITIVE MATERIALS CONTAINING FLUORINATED COMPOUNDS

[75] Inventors: Yukio Maekawa; Yasuo Mukunoki; Naohiko Sugimoto, all of Kanagawa, Japan

[73] Assignee: Fuji Photo Film Co., Ltd., Kanagawa, Japan

[21] Appl. No.: 495,878

[22] Filed: May 18, 1983

[30] Foreign Application Priority Data

May 18, 1982 [JP] Japan ..... 57-83566

[51] Int. Cl.[3] ..... G03C 1/78

[52] U.S. Cl. ..... 430/528; 430/631; 430/546; 430/935

[58] Field of Search ..... 430/528, 631, 546, 935

[56] References Cited

U.S. PATENT DOCUMENTS

| | | | |
|---|---|---|---|
| 3,888,678 | 6/1975 | Bailey et al. | 430/528 |
| 4,013,696 | 3/1977 | Babbitt et al. | 430/528 |
| 4,201,586 | 5/1980 | Hori et al. | 430/631 |
| 4,267,265 | 5/1981 | Sugimoto et al. | 430/527 |
| 4,304,852 | 12/1981 | Sugimoto et al. | 430/528 |
| 4,407,937 | 10/1983 | Sugimoto et al. | 430/527 |

*Primary Examiner*—Jack P. Brammer

*Attorney, Agent, or Firm*—Sughrue, Mion, Zinn, Macpeak & Seas

[57] ABSTRACT

A silver halide photographic light-sensitive material comprising a support having thereon at least one silver halide emulsion layer wherein the photographic light-sensitive material contains a compound represented by the following general formula (I):

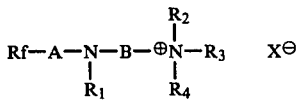

(I)

wherein Rf represents a saturated or unsaturated hydrocarbon group having from 3 to 20 carbon atoms wherein all or a part of the hydrogen atoms are substituted with fluorine atoms; A and B each represents a divalent linking group; $R_1$ represents a hydrogen atom or an alkyl group; $R_2$, $R_3$ and $R_4$ each represents an alkyl group and at least one of $R_1$, $R_2$, $R_3$ and $R_4$ represents an alkyl group substituted with a monovalent group, and X represents an anion.

The photographic light-sensitive material containing the compound represented by the general formula (I) provides improved antistatic properties without adversely affecting the photographic properties and can be prepared without problems during coating such as formation of "comets" and "repelling".

16 Claims, No Drawings

SILVER HALIDE PHOTOGRAPHIC LIGHT-SENSITIVE MATERIALS CONTAINING FLUORINATED COMPOUNDS

FIELD OF THE INVENTION

The present invention relates to a silver halide photographic light-sensitive material (hereinafter referred to simply as "photographic light-sensitive material"), and particularly, to a photographic light-sensitive material having an improved antistatic property and improved coating ability.

BACKGROUND OF THE INVENTION

Since photographic light-sensitive materials are generally composed of an electrically insulating support and photographic layers, static charges are frequently accumulated when the photographic materials are subjected to friction or separation caused by contact with the surface of the same or different materials during steps for production of the photographic light-sensitive materials or when using them for photographic purposes. These accumulated static charges cause many problems. The most serious problem is discharge of accumulated static charges prior to development processing, by which the light-sensitive emulsion layer is exposed to light to form dot spots or branched or feathery linear specks when development of the photographic films is carried out. This phenomenon is the so-called static mark. Due to the creation of such marks the commercial value of photographic films is significantly deteriorated, and is sometimes entirely lost. For example, with medical or industrial X-ray films, the static marks may result in a very dangerous judgment or misdiagnosis. This phenomenon is a very troublesome problem, because it becomes clear for the first time by carrying out development. Further, these accumulated static charges are also the origin of secondary problems such as adhesion of dusts to the surface of films, uneven coating, etc.

As described above, such static charges are frequently accumulated when producing and using photographic light-sensitive materials. For example, during production, they are generated by friction of the photographic film contacting a roller or by separation of the emulsion surface from the support surface during a rolling or unrolling step. Further, they are generated on X-ray films in an automatic camera by contact with or separating from mechanical parts or fluorescent sensitizing paper, or they are generated by contact with or separation from rollers and bars made of rubber, metal, or plastics in a bonding machine or an automatic developing machine in a developing lab or in a camera in the case of using color negative films or color reversal films. In addition, they are generated by contact with packing materials, etc.

Static marks on photographic light-sensitive materials occurring due to accumulation and discharge of static charges increase with increases in the sensitivity of the photographic light-sensitive materials and an increase of the handling speed. Particularly, static marks are easily generated because of high sensitization of the photographic light-sensitive materials and severe handling conditions such as high speed coating, high speed photographing, and high speed automatic treatment.

In order to prevent problems caused by static charges, it is suitable to add an antistatic agent to the photographic light-sensitive materials. However, antistatic agents conventionally used in other fields cannot be used freely for photographic light-sensitive materials, because they are subjected to various specific restrictions due to the nature of the photographic light-sensitive materials. More specifically, the antistatic agents which can be used in the photographic light-sensitive materials must have excellent antistatic abilities while not having adverse influences upon photographic properties of the photographic light-sensitive materials, such as sensitivity, fog, granularity, sharpness. Further, such agents must not have adverse influences upon the film strength of the photographic light-sensitive materials (the photographic light-sensitive materials are not easily injured by friction or scratching). In addition, such agents must not have an adverse influence upon antiadhesion properties (the photographic light-sensitive materials do not easily adhere when the surfaces of them are brought into contact with each other or with surfaces of other materials). Furthermore, the agents must not accelerate exhaustion of processing solutions for the photographic light-sensitive materials and not deteriorate adhesive strength between layers composing the photographic light-sensitive materials, etc. Accordingly, the application of antistatic agents to photographic light-sensitive materials are subject to many restrictions.

One method for overcoming problems caused by static charges comprises increasing electric conductivity of the surface of the photographic light-sensitive materials so that static charges disappear within a short time, prior to spark discharging of the accumulated charges.

Accordingly, processes for improving the electrically conductive property of the support or the surface of various coating layers in the photographic light-sensitive materials have been proposed hitherto, and utilization of various hygroscopic substances, water-soluble inorganic salts, certain kinds of surface active agents and polymers, etc., has been attempted. For example, it has been known to use polymers as described in U.S. Pat. Nos. 2,882,157, 2,972,535, 3,062,785, 3,262,807, 3,514,291, 3,615,531, 3,753,716, 3,938,999, etc., surface active agents as described in U.S. Pat. Nos. 2,982,651, 3,428,456, 3,457,076, 3,454,625, 3,552,972, 3,655,387, etc., and metal oxides and colloidal silica as described in U.S. Pat. Nos. 3,062,700, 3,245,833, 3,525,621, etc.

However, many of these substances exhibit great specificity, depending upon the kind of film support or the photographic composition. Although some substances produce good results on certain specific film supports, photographic emulsions or other photographic elements, they are not only useless for preventing generation of static charges when using different film supports and photographic elements, but also have an adverse influence upon photographic properties.

On the other hand, there are many cases wherein, although they have excellent antistatic effects, they cannot be used due to their adverse influence upon photographic properties such as sensitivity, fog, granularity, sharpness, etc. For example, it has been well known that polyethylene oxide compounds have antistatic effects, but they often have an adverse influence upon photographic properties, such as increase in fog, desensitization, deterioration of granularity, etc. Particularly, in light-sensitive materials in which both sides of the support are coated with photographic emulsions, such as medical direct X-ray light-sensitive materials, it has been difficult to develop techniques for effectively providing an antistatic property without having an adverse influence upon photographic properties. Thus, the application of antistatic agents to the photographic light-sensitive materials is very difficult, and their use is often limited to a certain range.

Another method for overcoming the problems of photographic light-sensitive materials caused by static charges comprises controlling the triboelectric series of the surface of the light-sensitive materials to reduce generation of static charges caused by friction or contacting as described above.

For example, it has been attempted to utilize fluorine containing surface active agents, as described in British Pat. Nos. 1,330,356, and 1,524,631, U.S. Pat. Nos. 3,666,478 and 3,589,906, Japanese Patent Publication No. 26687/77 and Japanese Patent Application (OPI) Nos. 46733/74, 32322/76, 84712/78 and 14224/79 (the term "OPI" as used herein refers to a "published unexamined Japanese patent application"), etc., for photographic light-sensitive materials for the above-described purpose.

However, photographic light-sensitive materials containing these fluorine containing surface active agents generally have an electrostatic property of charging in negative polarity. Accordingly, although it is possible to adapt the triboelectric series of the surface of the light-sensitive materials for each triboelectric series of rubber rollers, Delrin rollers and nylon rollers by suitably combining the fluorine containing surface active agents (having an electrostatic property of charging in negative polarity) with surface active agents having an electrostatic property of charging in positive polarity, problems still occur, because the triboelectric series of the surface of the light-sensitive material cannot be simultaneously adapted for all triboelectric series of rubber rollers, Delrin rollers and nylon rollers. That is, when such fluorine containing surface active agents are used so as to adapt for rubber, branched static marks occur due to Delrin, of which the triboelectric series is situated on the positive side as compared with the triboelectric series of rubber; and when they are used so as to adapt for Delrin, spot static marks occur due to the rubber, of which the triboelectric series is situated on the negative side as compared with the triboelectric series of Delrin.

In order to compensate for this fault, there are processes which comprise reducing the surface resistance by using high molecular electrolytes together therewith as described in British Pat. No. 1,293,189. However, they also produce adverse effects; for example, they cause deterioration of antiadhesion properties and have an adverse influence upon photographic properties. Accordingly, it is impossible to incorporate them so as to provide a sufficient antistatic property.

Further, as a method in which the dependency on various materials with respect to the triboelectric series is small, fluorine containing cationic surface active agents are utilized as described in U.S. Pat. No. 3,850,642, Japanese Patent Application (OPI) Nos. 52223/73 and 127974/77, etc. However, it has been found that such technique does not have good coating properties during the production of photographic light-sensitive materials.

More specifically, it is well known that the photographic light-sensitive materials are prepared by applying a subbing layer, a silver halide photographic emulsion layer, a protective layer, a filter layer, an antihalation layer and an intermediate layer, etc., to a support composed of cellulose acetate, polyester, or polyethylene laminated paper, etc. When producing photographic light-sensitive materials having this number of layers, the coating solutions must be applied in a uniform thin layer to avoid problems such as "repelling" (i.e., a very small spot which is uncoated with a coating solution), etc. Furthermore, when producing photographic light-sensitive materials, sometimes the photographic emulsions and other gelatin containing coating solutions are applied to the support at the same time to form a multilayer structure. For example, in order to produce a color photographic light-sensitive material, three or more photographic emulsion layers are formed simultaneously by continuous application. When applying a gelatin or another colloid solution to such a gelatin colloid layer, it is very difficult to obtain coating properties required for such a case as compared with the case of applying the gelatin colloid solution directly to the support. It is particularly difficult when the layer to be applied is a wet layer set by cooling just after application. Hitherto, although many fluorine containing cationic surface active agents have been used as antistatic agents, most of them have inferior coating ability, particularly in high speed applications, and they cause formation of "comets", i.e., local imperfect coating caused by insoluble substances or dusts, "repelling" and unevenness. In order to dissolve these problems, a method wherein nonionic surface active agents are used together with fluorine containing surface active agents has been disclosed in U.S. Pat. Nos. 3,775,126 and 4,013,696, etc. However, this method is useful only for specified photographic coating solutions or under specified coating conditions, and lacks wide applicability. Also, problems in photographic properties such as desensitization occur by the use of nonionic surface active agents.

SUMMARY OF THE INVENTION

An object of the present invention is to provide an antistatic photographic light-sensitive material which is less subject to generate static electricity with respect to various substances.

Another object of the present invention is to provide a photographic light-sensitive material capable of forming a homogeneous suspension when applying a photographic coating solution containing or not containing various photographic binders, such as gelatin, at a high speed to form a thin layer, and obtaining a uniform coating layer without causing problems such as "repelling", "comet", etc.

A further object of the present invention is to provide a photographic light-sensitive material having improved coating properties such as prevention of repelling, etc., for which can be easily applied second and third gelatin-containing layers to a gelatin containing photographic layer by means of plural coating machines or in the case of applying them to a subbing layer at the same time or continuously to form a multilayer construction.

A still further object of the present invention is to provide a photographic light-sensitive material containing a fluorine containing cationic surface active agent which does not adversely affects on photographic properties.

Other objects of the present invention will become apparent from the following detailed description and examples.

These objects of the present invention have been attained by incorporating into a silver halide photographic light-sensitive material comprising a support having thereon at least one silver halide emulsion layer a fluorine containing cationic surface active agent having a specific substituent which is represented by the following general formula (I):

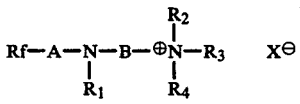

(I)

wherein Rf represents a saturated or unsaturated hydrocarbon group having from 3 to 20 carbon atoms wherein all or a part of the hydrogen atoms are substituted with fluorine atoms; A and B each represents a divalent linking group; $R_1$ represents a hydrogen atom or an alkyl group; $R_2$, $R_3$ and $R_4$ each represents an alkyl group and at least one of $R_1$, $R_2$, $R_3$ and $R_4$ represents an alkyl group substituted with a monovalent group; and X represents an anion.

DETAILED DESCRIPTION OF THE INVENTION

In the general formula (I) above, the alkyl group represented by $R_1$, $R_2$, $R_3$ or $R_4$ is preferably an alkyl group having from 1 to 12 carbon atoms and particularly from 1 to 6 carbon atoms.

Examples of the divalent linking group represented by A in the general formula (I) include the following groups.

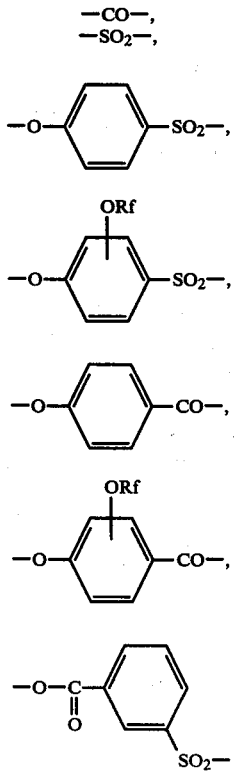

-continued

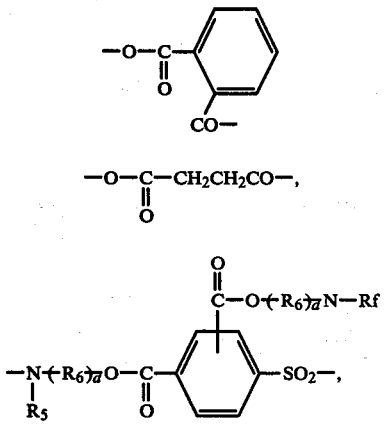

wherein Rf has the same meaning as defined above; $R_5$ represents a hydrogen atom or a substituted or unsubstituted alkyl group; $R_6$ represents an alkylene group (having from 1 to 5 carbon atoms); and d represents 0 or 1. Preferred examples of the divalent linking group represented by A in the general formula (I) include —CO— and —$SO_2$—.

Examples of the divalent linking group represented by B in the general formula (I) include the following groups.

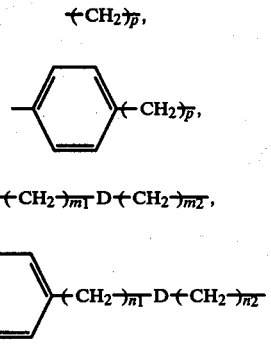

wherein D represents —O—, —S—, —COO—, —OCO—,

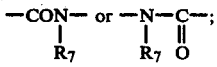

p, $m_1$, $m_2$, $n_1$ and $n_2$ each represents 0 or an integer from 1 to 4; and $R_7$ has the same meaning as defined for $R_1$. Preferred examples of the divalent linking group represented by B in the general formula (I) include $-(CH_2)_p$ and $-(CH_2)_{m1}D-(CH_2)_{m2}$ wherein p, D, $m_1$ and $m_2$ have the same meaning as defined above.

Examples of X in the general formula (I) include the following anions.

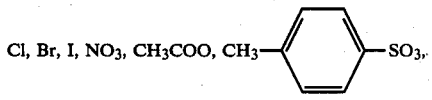

-continued

Compound (1)

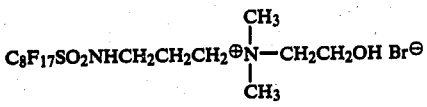

Compound (2)

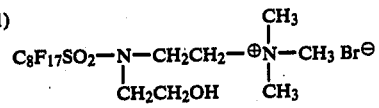

Compound (3)

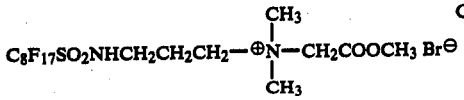

Compound (4)

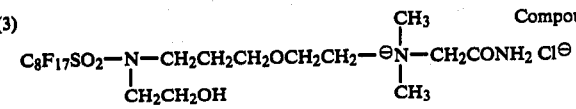

Compound (5)

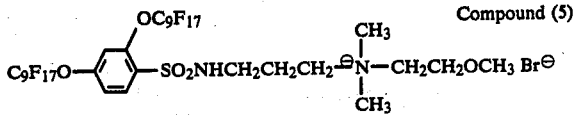

Compound (6)

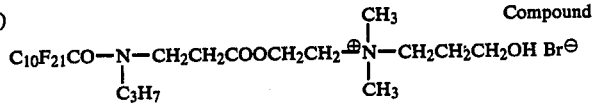

Compound (7)

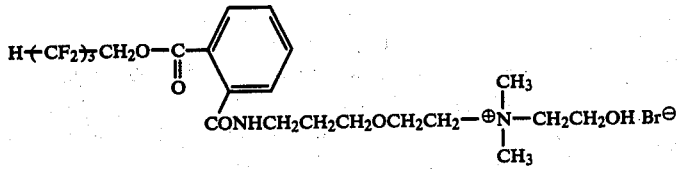

Compound (8)

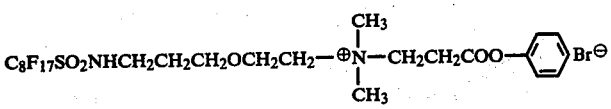

Compound (9)

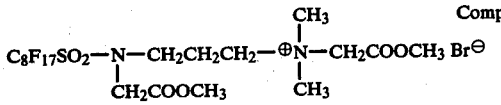

Compound (10)

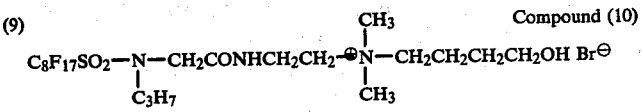

Compound (11)

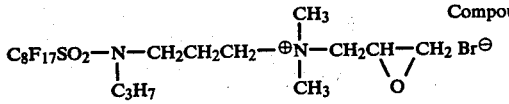

Compound (12)

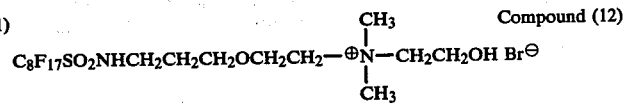

Compound (13)

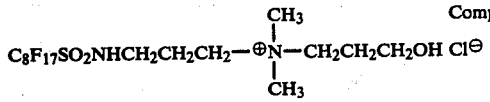

Compound (14)

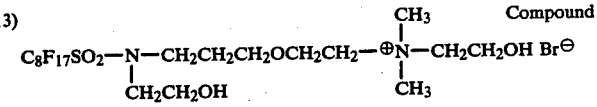

Compound (15)

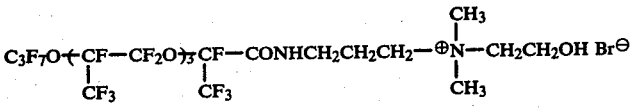

Compound (16)

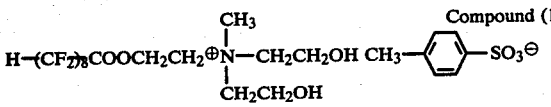

Compound (17)

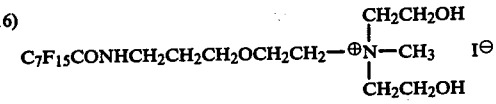

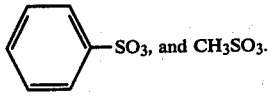

$-SO_3$, and $CH_3SO_3$.

Examples of the monovalent substituent for the alkyl group represented by $R_1$, $R_2$, $R_3$, $R_4$, $R_5$ or $R_7$ or the alkylene group represented by $R_6$ in the above formulae include a hydroxy group, an alkoxy group, an aryloxy group, an alkyloxycarbonyl group, an aryloxycarbonyl group, an epoxy group and a carbamoyl group, etc. Of these substituents, a hydroxy group, an alkoxy group, an epoxy group and alkyloxycarbonyl group are particularly preferred.

Specific examples of typical compounds according to the present invention are set forth below, but the present invention should not be construed as being limited thereto.

Preferred examples of typical compounds according to the present invention include Compounds (1), (2), (6), (12), (14) and (16).

The general methods for synthesizing the compounds used in the present invention are set forth, for example, in U.S. Pat. Nos. 2,759,019 and 2,764,602.

Specific examples of the method for synthesizing the compounds used in the present invention are set forth below.

SYNTHESIS EXAMPLE 1

Synthesis of Compound (1)

A mixture of 29.2 g of N-(3-dimethylamino)propylperfluorooctasulfonamide, 12.3 g of ethylene bromohydrin and 100 ml of toluene was refluxed by heating for 3 hours whereby the reaction was carried out. To the reaction solution was added 35 ml of methanol and the mixture was cooled to room temperature to deposit the colorless crystals. The crystals were collected by filtration, washed with 20 ml of acetone and recrystallized from a solvent mixture of acetone and ethanol (80 ml: 40 ml) to obtain 13.5 g of the needle-like crystals. m.p.: 169°-171° C.

SYNTHESIS EXAMPLE 2

Synthesis of Compound (3)

A mixture of 29.2 g of N-(3-dimethylamino)propylperfluorooctanesulfonamide, 6.0 g of methyl bromoacetate and 300 ml of methanol was refluxed by heating for 5 hours. The methanol was distilled off and to the residue was added 800 ml of isopropanol to crystallize. The resulting crystals were collected by filtration, washed with 100 ml of isopropanol and dried to obtain 23.1 g of the desired Compound (3). m.p.: 183°-186° C.

SYNTHESIS EXAMPLE 3

Synthesis of Compound (12)

139 g of N,N-dimethyl-N-[3-(perfluorooctylsulfonyl-)aminopropoxy]ethylamine and 33.2 g of ethylene bromohydrin were refluxed by heating for 3 hours, whereby the reaction was carried out. After the completion of the reaction, 600 ml of ethyl acetate was added to the reaction mixture and cooled. The crystals thus-deposited were collected by filtration, washed thoroughly with 180 ml of acetone and dried under a reduced pressure in a desiccator. The yield was 113 g. m.p.: 160° C.

SYNTHESIS EXAMPLE 4

Synthesis of Compound (14)

To 31.4 g of N,N-dimethyl-N-[3-(perfluorooctanesulfonyl)aminopropoxy]ethylamine was added 19.3 g of sodium methylate and the methanol was distilled off under a reduced pressure. To the residue was added 90 ml of anhydrous acetonitrile to dissolve and to the solution was added 11.3 g of ethylene bromohydrin. The mixture was continually stirred at 82° C. for 10 hours and then 200 ml of isopropanol was added to the mixture and cooled to deposit the crystals. The crystals were collected by filtration and recrystallized from a solvent mixture of acetonitrile and ethanol (300 ml: 20 ml). The crystals were collected by filtration, washed with 20 ml of acetone, and dried under a reduced pressure in a desiccator. The yield was 13 g.

The compound of the present invention is added to at least one of the layers constituting the photographic light-sensitive material. It is preferably added to a layer other than a silver halide emulsion layer, for example, a surface protective layer, a back layer, an intermediate layer, or a subbing layer, etc. When the back layer consists of two layers, the compound may be added to any of them. Furthermore, the compound may be applied as an overcoating on the surface protective layer.

In order to obtain the best effects of the present invention, the compound of the invention is preferably added to a surface protective layer, a back layer, or an overcoating layer.

In the case of applying the compound according to the present invention to the photographic light-sensitive material, the compound is dissolved in water, an organic solvent such as methanol, isopropanol, or acetone, etc., or a mixture thereof, and the resulting solution is added to a coating solution for a surface protective layer or a back layer, etc. Then, the coating solution is applied by a dip coating method, an airknife coating method, or an extrusion coating method using a hopper as described in U.S. Pat. No. 2,681,294, or by a method described in U.S. Pat. Nos. 3,508,947, 2,941,898 and 3,526,528, etc., by which two or more layers are applied at the same time, or the photographic light-sensitive material is dipped in an antistatic solution. Further, if desired, the antistatic solution containing the compound of the present invention can be additionally applied onto the protective layer.

It is preferred that an amount of the compound according to the present invention be from 0.0001 to 2.0 g, and preferably from 0.0005 to 0.05 g, per square meter of the photographic light-sensitive material.

However, the above-described amount can vary according to the particular kind of photographic film base to be used, the photographic composition, the form and method of coating.

Examples of the support for the photographic light-sensitive material of the present invention include a cellulose nitrate film, a cellulose acetate film, a cellulose acetate butyrate film, a cellulose acetate propionate film, a polystyrene film, a polyethylene terephthalate film, a polycarbonate film and a laminate thereof, etc. Preferred examples of the support for the photographic light-sensitive material of the present invention include a cellulose triacetate film and a polyethylene terephthalate film. In more detail, it is possible to use paper coated or laminated with baryta or an α-olefin polymer, and particularly a polymer of α-olefin having from 2 to 10 carbon atoms such as polyethylene, polypropylene, ethylene-butene copolymer, etc.

In the photographic light-sensitive material of the present invention, each photographic layer can contain a binder. Examples of useful binders include as a hydrophilic colloid a protein such as gelatin, colloidal albumin, casein, etc.; a cellulose compound such as carboxymethyl cellulose, hydroxyethyl cellulose, etc.; a saccharide such as agar, sodium alginate or a starch derivative, etc.; and a synthetic hydrophilic colloid, for example, polyvinyl alcohol, poly-N-vinylpyrrolidone, a polyacrylic acid copolymer, polyacrylamide, a derivative thereof, a partially hydrolyzed product thereof, etc. If desired, these colloids can be used as a mixture of two or more thereof.

Among them, gelatin is the most suitable. "Gelatin" as used herein means the so-called lime-processed gelatin, acid-processed gelatin, and enzyme-processed gelatin. A part or the whole of the gelatin can be replaced by a synthetic polymeric material. Further, it may be replaced by a gelatin derivative, such as a derivative obtained by treating or modifying an amino group, an imino group, a hydroxy group, or a carboxyl group contained in the gelatin molecule as a functional group with a reagent having a group capable of reacting therewith or a graft polymer obtained by bonding thereto a polymeric material.

The silver halide emulsion for the photographic light-sensitive material used in the present invention can be generally produced by mixing a solution of a water-soluble silver salt (for example, silver nitrate) with a solution of a water-soluble halide (for example, potassium bromide) in the presence of a solution of a water-soluble high molecular material such as gelatin. As the silver halide, it is possible to use not only silver chloride and silver bromide, but also a mixed silver halide such as silver chlorobromide, silver iodobromide, silver chloroiodobromide, etc.

The photographic emulsion can be subjected to spectral sensitization or supersensitization using a polymethine sensitizing dye such as cyanine, merocyanine, carbocyanine, etc., alone or as a combination thereof, or by using such a dye in combination with a styryl dye, etc.

Furthermore it is possible to add various compounds to the photographic emulsion for the photographic light-sensitive material used in the present invention in order to prevent deterioration of sensitivity or the occurrence of fog in the step for production of the light-sensitive material, during preservation or during processing. Many such compounds are known, examples of which include a heterocyclic compound including 4-hydroxy-6-methyl-1,3,3a,7-tetraazaindene, 3-methylbenzothiazole and 1-phenyl-5-mercaptotetrazole, etc., a mercury containing compound, a mercapto compound, a metal salt, etc.

When using the silver halide photographic emulsion as a color photographic light-sensitive material, the silver halide emulsion layer may contain a coupler. Useful couplers include 4-equivalent diketomethylene yellow coupler, a 2-equivalent diketomethylene yellow coupler, a 4-equivalent or a 2-equivalent pyrazolone magenta coupler, an indazolone magenta coupler, an α-naphthol cyan coupler and a phenol cyan coupler.

The silver halide emulsion layer and other layers in the photographic light-sensitive material of the present invention can be hardened by various organic and inorganic hardening agents (alone or as a combination). Examples thereof include an aldehyde compound such as mucochloric acid, formaldehyde, trimethylolmelamine, glyoxal, 2,3-dihydroxy-1,4-dioxane, 2,3-dihydroxy-5-methyl-1,4-dioxane, succinaldehyde, and glutaraldehyde; an active vinyl compound such as divinyl sulfone, methylenebismaleimide, 1,3,5-triacryloylhexahydro-s-triazine, 1,3,5-trivinylsulfonylhexahydro-s-triazine, bis(vinylsulfonylmethyl)ether, 1,3-bis(vinylsulfonylmethyl)propanol-2, and bis(α-vinylsulfonylacetamido)ethane; an active halogen compound such as sodium salt of 2,4-dichloro-6-hydroxy-s-triazine and 2,4-dichloro-6-methoxy-s-triazine; and an ethyleneimine compound such as 2,4,6-triethyleneimino-s-triazine, etc.

A surface active agent may be added alone or as a mixture to the photographic constituting layer of the present invention. It may be used as a coating aid, but it can sometimes be used for other purposes, for example, for emulsification or dispersion, sensitization, or improvement or other photographic properties and control of triboelectric series.

The surface active agents are classified into a natural surface active agents such as saponin, etc.; nonionic surface active agents such as alkylene oxide type, glycerine type or glycidol type active agents; cationic surface active agents such as higher alkylamine, quaternary ammonium salts, pyridine and other heterocyclic compounds, sulfonium compounds, or phosphonium compounds, etc.; anionic surface active agents containing an acid group such as a carboxylic acid group, a sulfonic acid group, a phosphoric acid group, a sulfuric acid ester group, or a phosphoric acid ester group, etc.; and amphoteric surface active agents such as amino acids, aminosulfonic acids, or sulfuric or phosphoric acid esters of aminoalcohols, etc.

Some examples of useful surface active agents are described in U.S. Pat. Nos. 2,271,623, 2,240,472, 2,288,226, 2,739,891, 3,068,101, 3,158,484, 3,201,253, 3,210,191, 3,294,540, 3,415,649, 3,441,413, 3,442,654, 3,475,174, 3,545,974, 3,666,478 and 3,507,660, British Pat. No. 1,198,450,in Ryohei Oda et al., *Kaimen Kasseizai no Gosei to sono Oyo* (published by Maki Shoten Co., 1964), in A. W. Perry, *Surface Active Agents* (Interscience Publication Incorporated, 1958), and in J. P. Sisley, *Encyclopedia of Active Agents,* Vol. 2 (Chemical Publishing Company, 1964).

In the present invention, a fluorine containing surface active agent other than the compound represented by the general formula (I) of the present invention can also be used. Examples of such fluorine containing surface active agents include fluorine containing surface active agents as described in British Pat. Nos. 1,330,356 and 1,524,631, U.S. Pat. Nos. 3,666,478 and 3,589,906, Japanese Patent Publication No. 26687/77 and Japanese Patent Application (OPI) Nos. 46733/74 and 32322/76, etc.

Furthermore, the photographic layer may contain a lubricating composition such as modified silicone as described, for example, in U.S. Pat. Nos. 3,079,837, 3,080,317, 3,545,970 and 3,294,537 and Japanese Patent Application (OPI) No. 129520/77.

In the photographic light-sensitive material of the present invention, the photographic layer may contain a polymer latex as described in U.S. Pat. Nos. 3,411,911 and 3,411,912, and Japanese Patent Publication No. 5331/70, or silica, strontium sulfate, barium sulfate or polymethyl methacrylate, etc., as a matting agent.

The photographic constituting layer in the photographic light-sensitive material of the present invention may contain an ultraviolet ray absorbing agent such as those described in U.S. Pat. Nos. 3,253,921, 3,707,375, 3,271,156, 3,794,493, 3,698,907 and 4,195,999 and Japanese Patent Application (OPI) No. 56620/76 in an emulsion dispersed state or a latex dispersed state.

According to the present invention, problems originating from static charges generated during production of the photographic light-sensitive material and/or in the case of using the photographic light-sensitive material can be overcome.

For example, formation of static marks caused by contact of the emulsion surface of the photographic light-sensitive material with the back surface, contact of the emulsion surface with another emulsion surface, or contact of the emulsion surface with materials which frequently contact with the photographic light-sensitive material, such as rubber, metal, plastics, fluorescent sensitizing paper, etc., is remarkably reduced by carrying out the present invention.

In the following, the effects of the present invention are illustrated in detail by reference to the examples, but the present invention is not to be construed as being limited thereto.

EXAMPLE 1

To a surface of a polyethylene terephthalate film support having a thickness of about 175μ, an emulsion layer and then a protective layer were applied by a conventional method and dried to prepare Samples 1-1 to 1-5. The composition of each layer was as follows:

Emulsion Layer: about 5μ:

Binder: Gelatin 2.5 g/m$^2$

Silver coated amount: 5 g/m$^2$

Composition of silver halide: AgI 1.5 mol% and AgBr 98.5 mol%

Antifogging agent: 1-Phenyl-5-mercaptotetrazole 0.5 g/Ag 100 g

Protective Layer: about 1μ:

Binder: Gelatin 1.7 g/m²

Coating aid: Sodium salt of N-oleyl-N-methyltaurine 7 mg/m²

Hardening agent: Sodium salt of 2,4-dichloro-6-hydroxy-1,3,5-triazine 0.4 g/100 g gelatin.

Sample 1-1 was composed of only the above-described compositions, and Samples 1-2 to 1-4 were composed of the above-described compositions, but additionally the protective layer contained Compounds (1), (4) and (11) according to the present invention in an amount of 1.5 mg/m², respectively.

Additionally, for comparison, Sample 1-5 was prepared wherein 1.5 mg/m² of Comparative Compound (A) was added to the above-described composition to form a protective layer.

Comparative Compound (A):

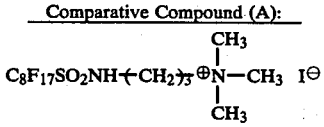

In order to evaluate the coating ability of these samples, the number of "repelling" spots in 1 square meter of the samples was counted (naked eye examination).

Further, after the unexposed samples were conditioned at 25° C. and 25% RH for 2 hours, they were subjected to friction by a rubber roller and a Delrin roller in a dark room under the same conditioning condition as described above. Thereafter, they were developed with the following developing solution, fixed and washed with water, and the occurrence of static marks was examined.

| Composition of Developing Solution: | |
|---|---|
| Warm water | 800 ml |
| Sodium tetrapolyphosphate | 2.0 g |
| Anhydrous sodium sulfite | 50 g |
| Hydroquinone | 10 g |
| Sodium carbonate (monohydrate) | 40 g |
| 1-Phenyl-3-pyrazolidone | 0.3 g |
| Potassium bromide | 2.0 g |
| Water to make | 1,000 ml (pH 10.2) |

Results of examination of the antistatic property and the coating ability of these samples are shown in Table 1.

TABLE 1

| Sample No. | Antistatic Agent | Occurrence of Static Marks | | Coating Ability (number of repelling spots/m²) |
|---|---|---|---|---|
| | | Rubber | Nylon | |
| 1-1 | None | D | D | 0 |
| 1-2 | Compound (1) | A | A | 0 |
| 1-3 | Compound (4) | A | A | 0 |
| 1-4 | Compound (11) | A | A | 0 |
| 1-5 | Comparative Compound (A) | B | B | 10 |

In Table 1, evaluation of the occurrence of static marks was carried out according to the following four stages:

A: The occurrence of static marks was not observed.

B: The occurrence of static marks was slightly observed.

C: The occurrence of static marks was considerably observed.

D: The occurrence of static marks was observed on nearly the whole surface.

As is clear from the results shown in Table 1 above, antistatic samples using the compounds according to the present invention show excellent antistatic effects, by which the occurrence of static marks was hardly observed, and it is understood that they did not have any adverse influence upon the coating ability. On the contrary, in the control sample, the antistatic property was very poor. In Sample 1-5 used for comparison, the antistatic property was somewhat improved, but the coating ability deteriorated.

EXAMPLE 2

Samples 2-1, 2-2, 2-3 and 2-4 composed of a cellulose triacetate support, an antihalation layer, a red-sensitive layer, an intermediate layer, a green-sensitive layer, a yellow filter layer, a blue-sensitive layer and a protective layer which were superposed in this order were prepared by coating and drying according to a conventional method. The composition of each layer was as follows.

Antihalation Layer:

Binder: Gelatin 4.4 g/m²

Hardening agent: 1,3-Bis(vinylsulfonyl)propanol-2 1.2 g/100 g binder

Coating aid: Sodium dodecylbenzenesulfonate 4 mg/m²

Antihalation component: Black colloidal silver 0.4 g/m²

Red-Sensitive Layer:

Binder: Gelatin 7 g/m²

Hardening agent: 1,3-Bis(vinylsulfonyl)propanol-2 1.2 g/100 g binder

Coating aid: Sodium dodecylbenzenesulfonate 10 mg/m²

Silver coated amount: 3.1 g/m²

Composition of silver halide: AgI 2 mol% and AgBr 98 mol%

Antifogging agent: 4-Hydroxy-6-methyl-1,3,3a,7-tetraazaindene 0.9 g/Ag 100 g

Color forming coupler: 1-Hydroxy-4-(2-acetylphenyl)azo-N-[4-(2,4-di-tert-amylphenoxy)-butyl]-2-naphthamide 38 g/Ag 100 g Sensitizing dye: Pyridinium salt of anhydro-5,5'-dichloro-9-ethyl-3,3'-di(3-sulfopropyl)thiacarbocyanine hydroxide 0.3 g/Ag 100 g Intermediate Layer:

Binder: Gelatin 2.6 g/m²

Hardening agent: 1,3-Bis(vinylsulfonyl)propanol-2 1.2 g/100 g binder

Coating aid: Sodium dodecylbenzenesulfonate 12 mg/m²

Green-Sensitive Layer:

Binder: Gelatin 6.4 g/m²

Hardening agent: 1,3-Bis(vinylsulfonyl)propanol-2 1.2 g/100 g binder

Coating aid: Sodium dodecylbenzenesulfonate 9 mg/m²

Silver coated amount: 2.2 g/m²

Composition of silver halide: AgI 3.3 mol% and AgBr 96.7 mol%

Stabilizer: 4-Hydroxy-6-methyl-1,3,3a,7-tetraazaindene 0.6 g/Ag 100 g

Color forming coupler: 1-(2,4,6-Trichlorophenyl)-3-[3-(2,4-di-tert-amylphenoxy)acetamido]benzamido-4-(4-methoxyphenyl)azo-5-pyrazolone 37 g/Ag 100 g Sensitizing dye: Pyridinium salt of anhydro-5,5'-diphenyl-9-ethyl-3,3'-di(2-sulfoethyl)oxacarbocyanine hydroxide 0.3 g/Ag 100 g Yellow Filter Layer:

Binder: Gelatin 2.3 g/m$^2$

Filter component: Yellow colloidal silver 0.7 g/m$^2$

Hardening agent: 1,3-Bis(vinylsulfonyl)propanol-2 1.2 g/100 g binder

Surface active agent: Sodium salt of 2-sulfonatosuccinic acid bis(2-ethylhexyl)ester 7 mg/m$^2$ Blue-Sensitive Layer:

Binder: Gelatin 7 g/m$^2$

Hardening agent: 1,3-Bis(vinylsulfonyl)propanol-2 1.2 g/100 g binder

Coating aid: Sodium dodecylbenzenesulfonate 8 mg/m$^2$

Silver coated amount: 2.2 g/m$^2$

Composition of silver halide: AgI 3.3 mol% and AgBr 96.7 mol%

Stabilizer: 4-Hydroxy-6-methyl-1,3,3a,7-tetraazaindene 0.4 g/Ag 100 g

Color forming coupler: 2'-Chloro-5'-[2-(2,4-di-tert-amylphenoxy)butyramido]-α-(5,5'-dimethyl-2,4-dioxo-3-oxazolidinyl)-α-(4-methoxybenzoyl-)acetanilide 45 g/Ag 100 g Protective Layer:

Binder: Gelatin 2 g/m$^2$

Hardening agent: 1,3-Bis(vinylsulfonyl)propanol-2 1.2 g/100 g binder

Coating aid: Sodium dioctylsulfosuccinate 5 mg/m$^2$

Matting agent: Copolymer of methyl methacrylate and methacrylic acid (ratio of copolymerization: 6:4, average particle size: 2.5μ) 100 mg/m$^2$.

Sample 2-1 was composed of only the above-described compositions, and Samples 2-2, 2-3 and 2-4 were composed of the above-described compositions, but additionally the protective layer contained Compounds (2) and (9) according to the present invention and Comparative Compound (A), respectively, in an amount of 6 mg/m$^2$. These samples were subjected to development processing by a conventional color development process, and the antistatic property and the coating ability were examined in the same manner as described in Example 1. The results obtained are shown in Table 2.

TABLE 2

| Sample No. | Antistatic Agent | Coating Ability (numbers of repelling spots/m$^2$) | Occurrence of Static Marks | |
|---|---|---|---|---|
| | | | Rubber | Delrin |
| 2-1 | None (control) | 0 | D | D |
| 2-2 | Compound (2) | 0 | A | A |
| 2-3 | Compound (9) | 0 | A | A |
| 2-4 | Comparative Compound (A) | 11 | B | C |

It is understood from the results shown in Table 2 above that in the samples using the compounds according to the present invention, the antistatic property was remarkably improved without deteriorating the coating ability.

On the other hand, when these samples were exposed to light according to a JIS method and thereafter subjected to color development processing in a conventional manner, Sample 2-4 (using the comparative compound) exhibited significant desensitization in the blue, green, and red sensitive layers. However, in the case of using the compounds according to the present invention, deterioration of the photographic properties was hardly observed.

EXAMPLE 3

Samples 3-1, 3-2, 3-3, 3-4 and 3-5 were prepared by coating and drying according to a conventional method, wherein a back layer and a protective layer for the back layer were applied to one side of a cellulose triacetate support and an antihalation layer, a red-sensitive layer, an intermediate layer, a green-sensitive layer, a yellow filter layer, a blue-sensitive layer, and a protective layer were applied in this order to the reverse side. The composition of each layer was as follows.

Back Layer:

Binder: Lime-processed gelatin 6.2 g/m$^2$

Salt: Potassium nitrate 0.1 g/m$^2$

Hardening agent: 1,3-Bis(vinylsulfonyl)propanol-2 0.6 g/100 g binder

Protective Layer for the Back Layer:

Binder: Lime-processed gelatin 2.2 g/m$^2$

Matting agent: Polymethyl methacrylate (average particle size: 2.5μ) 20 mg/m$^2$ Hardening agent: 1,3-Bis(vinylsulfonyl)propanol-2 1.2 g/100 g binder Coating aid:

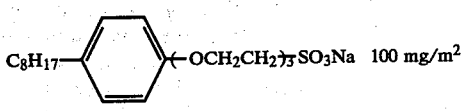

100 mg/m$^2$

The antihalation layer and the other layers were the same as those described in Example 2, and the protective layer was the same as that in Sample 2-2.

Sample 3-1 was composed of only the above-described compositions. Sample 3-2 was composed of the above-described compositions, except that Compound (1) according to the present invention was added to the protective layer for the back layer in an amount of 1.5 mg/m$^2$. Sample 3-3 was composed of the same compositions except that the Compound (3) according to the present invention was added in an amount of 3 mg/m$^2$. Sample 3-4 was composed of the same compositions, except that Compound (12) according to the present invention was added in an amount of 9 mg/m$^2$. Further, Sample 3-5 was produced as a comparative sample by adding Comparative Compound (B) having the following formula:

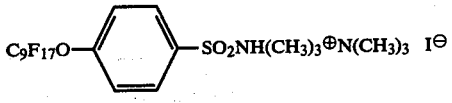

to the composition of Sample 3-1 so as to contain it in an amount of 3 mg/m$^2$ in the protective layer for the back layer.

The antistatic property and the coating ability of these samples were examined by the same manner as described in Example 1, except that the back surface thereof was subjected to friction by a rubber or Delrin roller. The results obtained are shown in Table 3.

TABLE 3

| Sample No. | Antistatic Agent | Coating Ability (number of repelling spots/m$^2$) | Occurrence of Static Marks | |
|---|---|---|---|---|
| | | | Rubber | Delrin |
| 3-1 | None | 0 | D | D |

TABLE 3-continued

| Sample No. | Antistatic Agent | Coating Ability (number of repelling spots/m²) | Occurrence of Static Marks Rubber | Delrin |
|---|---|---|---|---|
| | (control) | | | |
| 3-2 | Compound (1) | 0 | A | A |
| 3-3 | Compound (3) | 0 | A | A |
| 3-4 | Compound (12) | 0 | A | A |
| 3-5 | Comparative Compound (B) | 15 | A | C |

It is understood from the results shown in Table 3 above that in samples using the compounds according to the present invention, the antistatic property is remarkably improved without deteriorating the coating ability.

EXAMPLE 4

Samples 4-1 to 4-6 composed of a cellulose triacetate support, an antihalation layer, a red-sensitive layer, an intermediate layer, a green-sensitive layer, a yellow filter layer, and blue-sensitive layer each having the same composition as described in Example 2 and a protective lower layer and a protective upper layer having the compositions indicated below, were produced by coating at 85 m/min and drying by a conventional method.

Protective Lower Layer:

Binder: Gelatin 1.6 g/m²

Hardening agent: 1,3-Bis(vinylsulfonyl)propanol-2 1.2 g/100 g binder

Coating aid: Sodium dioctylsulfosuccinate mg/m²

Ultraviolet ray absorbing agent:

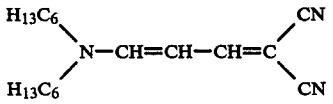

300 mg/m²

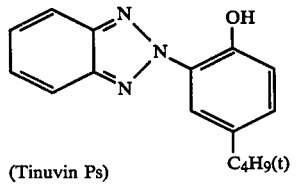

100 mg/m²

(Tinuvin Ps)

Protective Upper Layer:

Binder: Ossein acid Processed gelatin (isoelectric point: 7) 1 g/m²

Hardening agent: 1,3-Bis(vinylsulfonyl)propanol-2 1.2 g/100 g binder

Matting agent: Copolymer of methyl methacrylate and methacrylic acid (ratio of copolymerization: 5:5, average particle size: 3μ) 30 mg/m² Polymethyl methacrylate (average particle size: 3μ) 10 mg/m²

Sample 4-1 was composed of only the above-described compositions, and Samples 4-2, 4-3, 4-4 and 4-5 were composed of the above-described compositions except that Compound (13) according to the present invention or Comparative Composition (C) having the following formula:

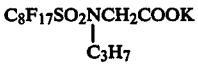

and a coating aid were added to each, as indicated in Table 4 below. The coating ability and the antistatic property of these samples were examined in the same manner as described in Example 2. The results obtained are shown in Table 4.

TABLE 4

| Sample No. | Coating Aid (mg/m²) | | Antistatic Agent (mg/m²) | | Coating Ability (number of repelling spots/m²) | Occurrence of Static Marks Rubber | Delrin |
|---|---|---|---|---|---|---|---|
| 4-1 | Sodium dioctylsulfosuccinate | 80 | None (control) | | 0 | D | D |
| 4-2 | Sodium dioctylsulfosuccinate | 7 | Compound (13) | 0.5 | 0 | A | A |
| 4-3 | Sodium dioctylsulfosuccinate | 80 | " | 9 | 0 | A | A |
| 4-4 | Sodium dioctylsulfosuccinate | 200 | " | 40 | 0 | A | A |
| 4-5 | Sodium dioctylsulfosuccinate | 30 | Comparative Compounds (C) | 6 | 1 | D | B |
| 4-6 | Sodium dioctylsulfosuccinate | 30 | Comparative Compound (C) | 18 | 1 | B | D |

As is clear from the results shown in Table 4 above, the samples using the compounds according to the present invention, the antistatic property was remarkably improved without deteriorating the coating ability. On the contrary, the comparative compound did not satisfy the antistatic property to a Delrin roller and a rubber roller at the same time, even when the amount of it was varied. Further, in Samples 4-2 to 4-4, using the compound according to the present invention, wetting and spreading of the developing solution were excellent, and, consequently, uneven development or adhesion of bubbles to the film surface did not occur. However, in Sample 4-5 and, particularly in Sample 4-6, using the comparative compound, the wetting of the developing solution was inferior.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive element comprising a support having thereon a silver halide emulsion layer wherein the photographic light-sensitive element contains a compound represented by the following formula (I) in an amount affective to improve antistatic properties and to improve coating ability:

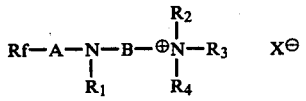

(I)

wherein Rf represents a saturated or unsaturated hydrocarbon group having from 3 to 20 carbon atoms wherein all or a part of the hydrogen atoms are substituted with fluorine atoms; A and B each represents a divalent linking group, wherein the divalent linking group represented by A is selected from the group consisting of:

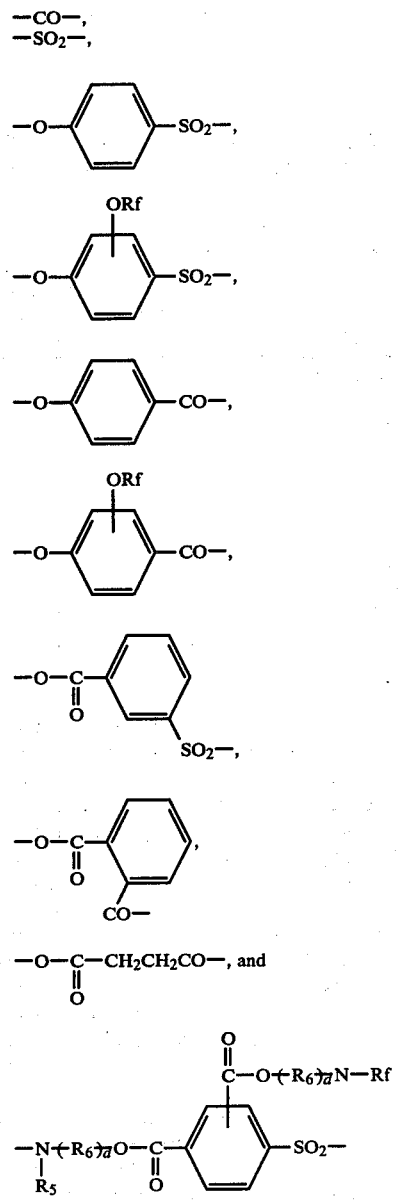

wherein $R_5$ represents a hydrogen atom or substituted or unsubstituted alkyl group; $R_6$ represents a substituted or unsubstituted alkylene group; and d represents 0 or 1;

wherein a substituent for the substituted alkyl group or the substituted alkylene group is selected from the group consisting of a hydroxy group, an alkoxy group, an alkyloxycarbonyl group, an aryloxycarbonyl group, an epoxy group and a carbamoyl group;

wherein the divalent linking group represented by B is selected from the group consisting of:

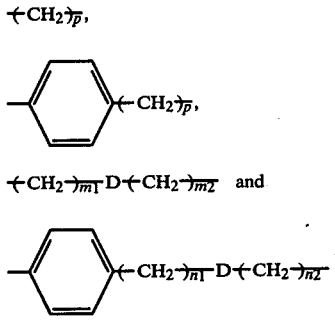

wherein D represents —O—, —S—, —COO—, —OCO—,

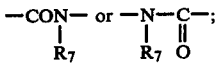

p, $m_1$, $m_2$, $n_1$ and $n_2$ each represents 0 or an integer from 1 to 4; and $R_7$ represents a hydrogen atom or an alkyl group;

$R_1$ represents a hydrogen atom or an alkyl group; $R_2$, $R_3$ and $R_4$ each represents an alkyl group and at least one of $R_1$, $R_2$, $R_3$ and $R_4$ represents an alkyl group substituted with a monovalent group selected from the group consisting of a hydroxy group, an alkoxy group, an aryloxy group, an alkyloxycarbonyl group, an aryloxycarbonyl group, an epoxy group and a carbamoyl group; and X represents an anion selected from the group consisting of:

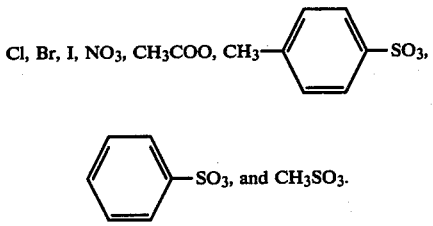

2. A silver halide photographic light-sensitive element as claimed in claim 1, wherein the alkyl group represented by $R_1$, $R_2$, $R_3$ or $R_4$ is an alkyl group having from 1 to 12 carbon atoms.

3. A silver halide photographic light-sensitive element as claimed in claim 1, wherein the alkyl group represented by $R_1$, $R_2$, $R_3$ or $R_4$ is an alkyl group having from 1 to 6 carbon atoms.

4. A silver halide photographic light-sensitive element as claimed in claim 1, wherein a substituent for the substituted alkyl group $R_2$, $R_3$ and $R_4$ is selected from the group consisting of a hydroxy group, an alkoxy group, an epoxy group and an alkyloxycarbonyl group.

5. A silver halide photographic light-sensitive element as claimed in claim 1, wherein a substituent for the substituted alkyl group or the substituted alkylene group $R_6$ is selected from the group consisting of a hydroxy group, an alkoxy group, an epoxy group and an alkyloxycarbonyl group.

6. A silver halide photographic light-sensitive element as claimed in claim 1, wherein a substituent for the alkyl group $R_5$ is selected from the group consisting of a hydroxy group, an alkoxy group, an aryloxy group, an alkyloxycarbonyl group, an aryloxycarbonyl group, an epoxy group and a carbamoyl group.

7. A silver halide photographic light-sensitive element as claimed in claim 1, wherein a substituent for the alkyl group $R_5$ is selected from the group consisting of a hydroxy group, an alkoxy group, an epoxy group and an alkyloxycarbonyl group.

8. A silver halide photographic light-sensitive element as claimed in claim 1, wherein the compound represented by the general formula (I) is present in a layer other than a silver halide emulsion layer.

9. A silver halide photographic light-sensitive element as claimed in claim 1, wherein the compound represented by the general formula (I) is present in a layer selected from the group consisting of a surface protective layer, a back layer, an intermediate layer, and a subbing layer.

10. A silver halide photographic light-sensitive element as claimed in claim 1, wherein the compound represented by the general formula (I) is present in a surface protective layer or a back layer.

11. A silver halide photographic light-sensitive element as claimed in claim 1, wherein the compound represented by the general formula (I) is present in an overcoating layer.

12. A silver halide photographic light-sensitive element as claimed in claim 1, wherein an amount of the compound represented by the general formula (I) is from 0.0001 to 2.0 $g/m^2$ of the photographic light-sensitive element.

13. A silver halide photographic light-sensitive element as claimed in claim 1, wherein an amount of the compound represented by the general formula (I) is from 0.0005 to 0.05 $g/m^2$ of the photographic light-sensitive element.

14. A silver halide photographic light-sensitive element as claimed in claim 1, wherein a layer in which the compound represented by the general formula (I) is present contains gelatin.

15. A silver halide photographic light-sensitive element as claimed in claim 1, wherein the photographic light-sensitive element further comprises a red-sensitive silver halide emulsion layer, a green-sensitive silver halide emulsion layer and a blue-sensitive silver halide emulsion layer.

16. A silver halide photographic light-sensitive element as claimed in claim 15, wherein the red-sensitive silver halide emulsion layer, the green-sensitive silver halide emulsion layer and the blue-sensitive silver halide emulsion layer contain a cyan color forming coupler, a magenta color forming coupler and a yellow color forming coupler, respectively.

* * * * *